US007338354B2

(12) United States Patent
Liu

(10) Patent No.: US 7,338,354 B2
(45) Date of Patent: Mar. 4, 2008

(54) WORKING PLATFORM OF TOOL CABINET

(76) Inventor: George Liu, No. 96, Sec. 3, Yunke Rd., Douliou City, Yunlin County (TW)

( * ) Notice: Subject to any disclaimer, the term of this patent is extended or adjusted under 35 U.S.C. 154(b) by 0 days.

(21) Appl. No.: 11/217,342

(22) Filed: Sep. 2, 2005

(65) Prior Publication Data

US 2007/0054608 A1 Mar. 8, 2007

(51) Int. Cl.
*B24B 41/00* (2006.01)

(52) U.S. Cl. ..... 451/361; 312/316; 312/317.1

(58) Field of Classification Search ..... 451/361; 312/313, 315, 316, 317.1, 317.2, 317.3
See application file for complete search history.

(56) References Cited

U.S. PATENT DOCUMENTS 2,044,559 A * 6/1936 Balster ..... 312/30
3,193,341 A * 7/1965 Preston ..... 312/245
6,113,202 A * 9/2000 Germano ..... 312/245

* cited by examiner

*Primary Examiner*—Jacob K. Ackun, Jr.
(74) *Attorney, Agent, or Firm*—Birch, Stewart, Kolasch & Birch, LLP

(57) ABSTRACT

The invention discloses a working platform of a tool cabinet, and the working platform is turned over on the tool cabinet, so that two working sides on different sides of the working platform can be used alternately, so as to maximize the utility of the limited space of the tool cabinet. Besides, the working side can install at least one accessory manufacture device which can be changed by a user, and thus making the working platform multifunctional.

11 Claims, 7 Drawing Sheets

WORKING PLATFORM OF TOOL CABINET

FIELD OF THE INVENTION

The present invention relates to a tool cabinet, and more particularly to a working platform structure of a tool cabinet.

BACKGROUND OF THE INVENTION

A tool cabinet is a cabinet for storing various different hand tools, and a working platform is usually set on the top of the cabinet for users to hammer, assembly, or repair an object, and the working platform is an indispensable equipment of DIY users.

To improve the convenience of using a tool cabinet and further meeting user requirements, the present tool cabinet has installed wheels and handles onto the tool cabinet, such that users can freely push or move the tool cabinet to perform various manufacturing and repairing operations. The tool cabinet of this kind can further meet user requirements.

However, the working platform of a prior art tool cabinet is monotonous, and users can simply use it for hammering, assembling and repairing. If a user needs to use an accessory device such as a vise or a grinding wheel, the user has to think of a way to fix the accessory device onto the working platform. Furthermore, the accessory device occupies much space of the working platform and affects the user's hammering, assembling or repairing operations. Therefore, the prior art working platform is unable to satisfy the requirements of the DIY users.

SUMMARY OF THE INVENTION

The primary objective of the present invention is to provide a working platform disposed on the top of a tool cabinet, and the working platform can be turned over on the tool cabinet, so that users can alternately use both working sides of the working platform.

The present invention relates to a working platform of a tool cabinet, and the working platform is disposed on a cabinet, and the working platform comprises a working board and at least one accessory manufacture equipment, and the working board has two working sides respectively disposed on two corresponding sides of the working board, and the working board is pivotally coupled onto the cabinet, so that the two working sides can be turned over by the working board and alternately shown on the cabinet. The accessory manufacture equipment is installed on the working side, such that the working platform can be turned over on the tool cabinet, and thus the two working sides on different sides of the working platform can be used alternately, and the working platform can be used to change the types of the accessory manufacture equipments as needed. Therefore, the working platform is multifunctional.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The technical contents of the present invention will now be described in more detail hereinafter with reference to the accompanying drawings that show various embodiments of the invention.

Figure 1:
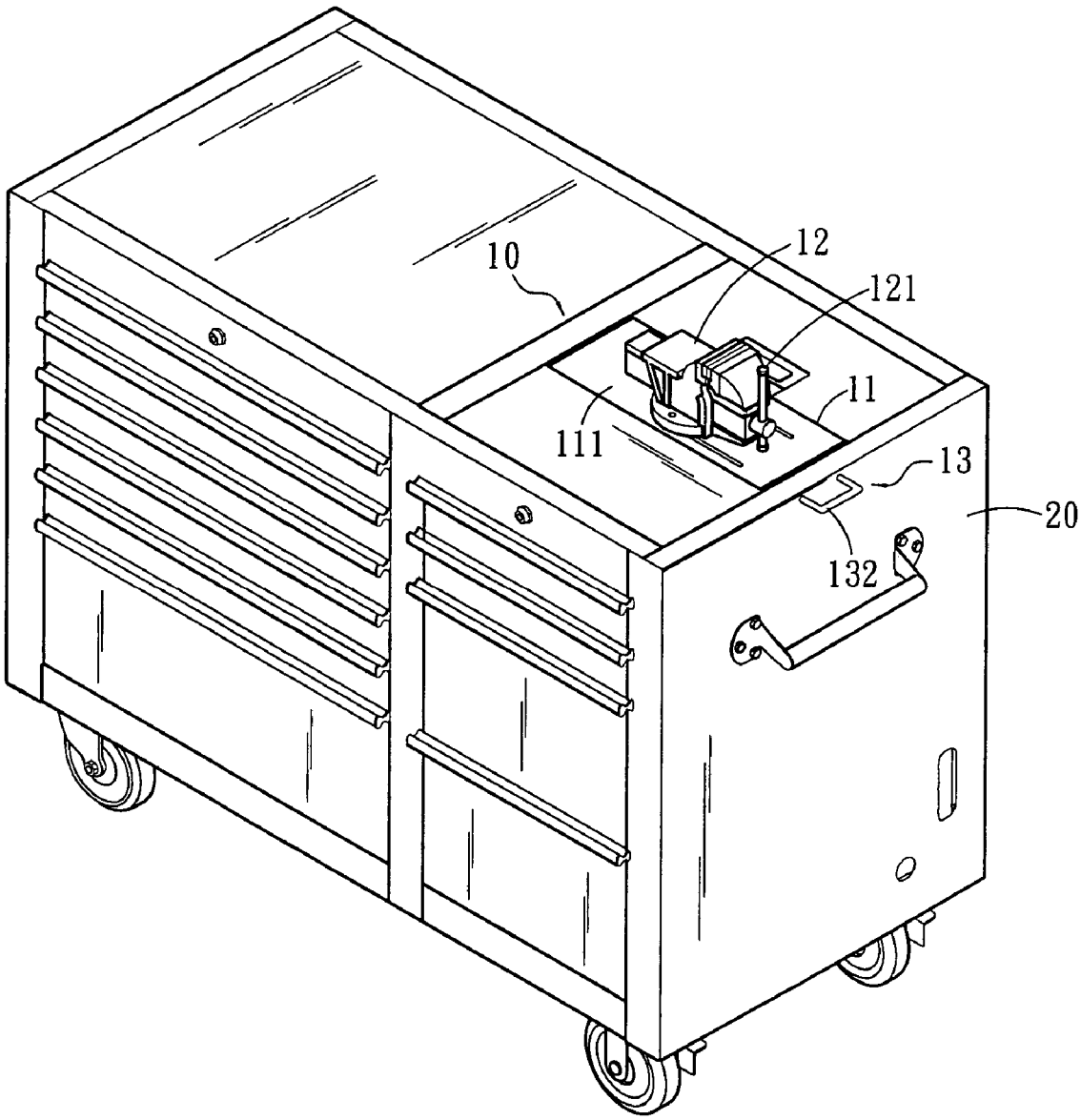
FIG. 1 is a view of an assembled structure of the present invention.
Figure 2:
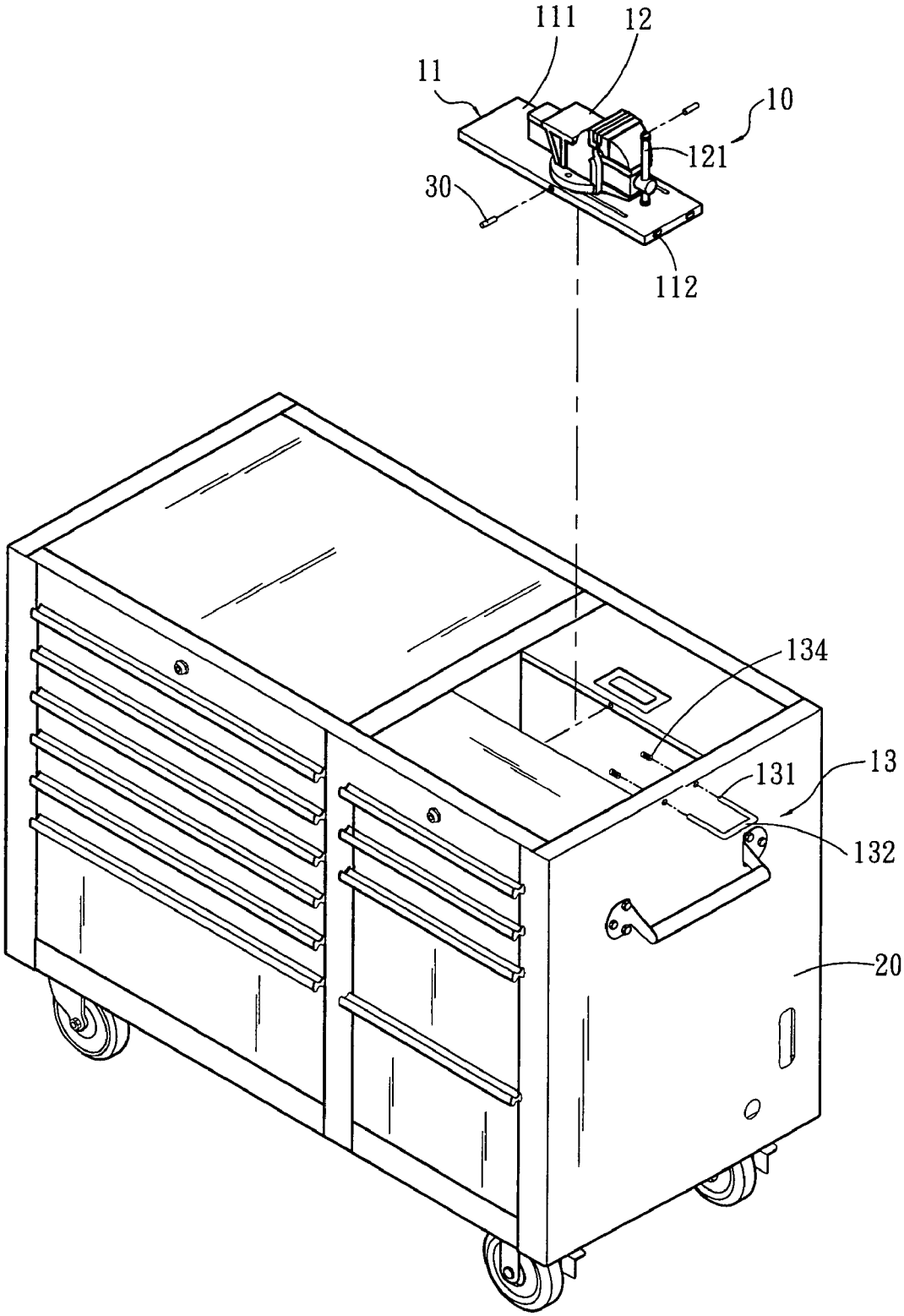
FIG. 2 is a view of a disassembled structure of the present invention.

Referring to FIGS. 1 and 2 for the working platform 10 of a tool cabinet 20 according to the present invention, the working platform 10 is installed onto a cabinet 20, and the working platform 10 comprises a working board 11 and at least one accessory manufacture equipment 12. The working board 11 includes two working sides 111 separately disposed on two corresponding sides of the working board 11, and the working board 11 is pivotally coupled onto the cabinet 20 by a pivotal axis 30, such that the two working sides 111 can be turned over by the working board 11 to be shown alternately show on the cabinet 20, and the accessory manufacture equipment 12 is set on the working side 111.

Figure 3A:
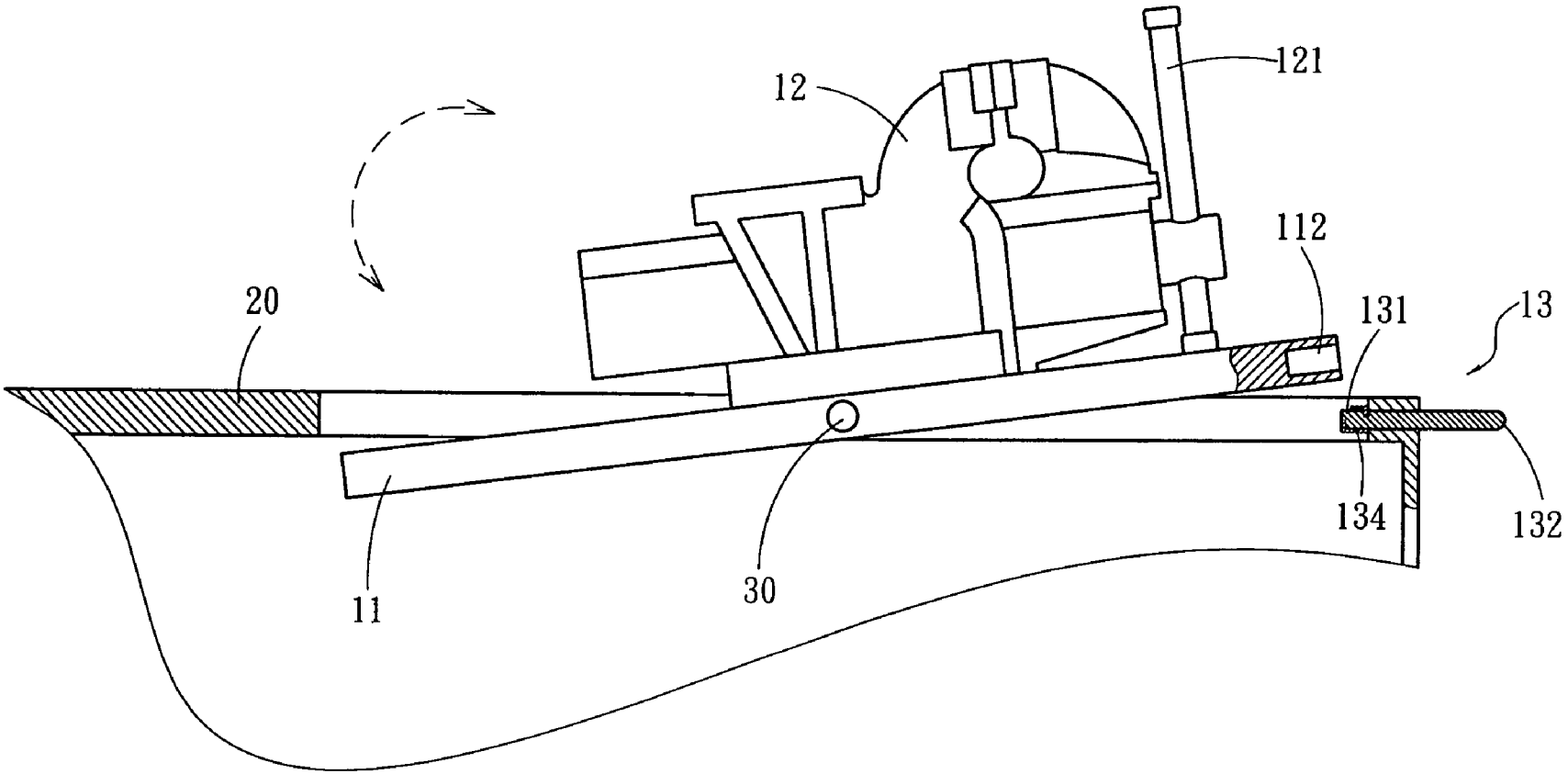
FIG. 3A is a schematic view of a working platform being turned over according to the present invention.
Figure 3B:
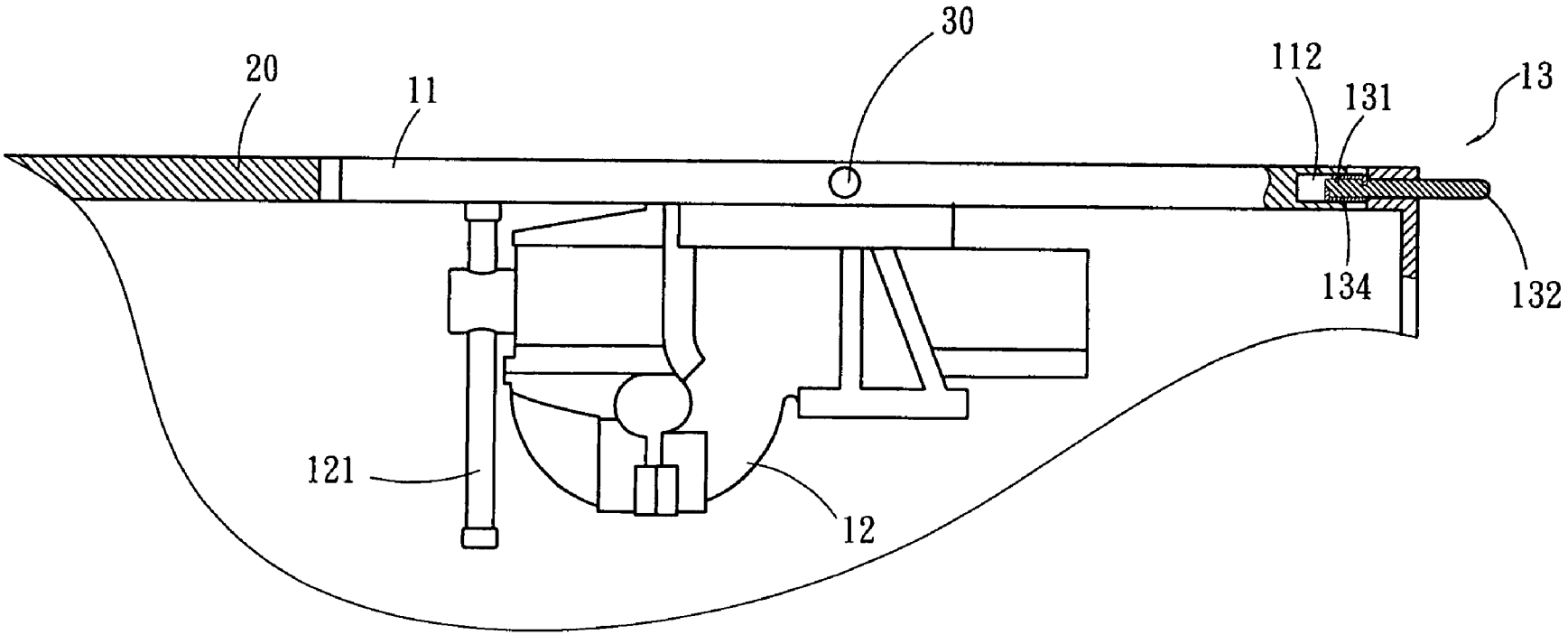
FIG. 3B is a schematic view of a working platform after being turned over according to the present invention.

Referring to FIGS. 3A and 3B, the working platform 10 of the present invention further comprises a pin positioning structure 13 disposed on the cabinet 20 having at least one insert post 131. The working board 11 comprises a hole 112 separately disposed on both sides corresponding to the insert post 131, so that when the two working sides 111 are turned over by the working board 11 and alternately shown on the top of the cabinet 20, the insert post 131 is moved to pass through the hole 112 and fix the working board 11.

The pin positioning structure 13 includes a handle 132, and the handle 132 is coupled and linked to the insert post 131, so that when a user turns the working board 11 over, the user can hold the handle 132 to move the insert post 131 to be separated from the hole 112. By that time, the working board 11 can be turned over as shown in FIG. 3A. When the working board 11 is turned over completely, the user can use the handle 132 to insert the insert post 131 into the hole 112 to fix the working board 11 again as shown in FIG. 3B.

Figure 4A:
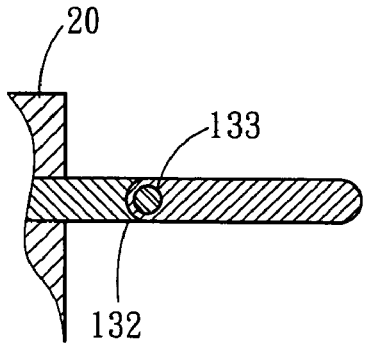
FIG. 4A is a schematic view of a handle having a bent pivot according to the present invention.
Figure 4B:
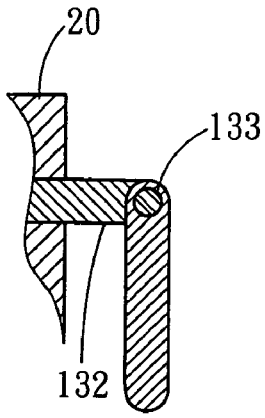
FIG. 4B is a schematic view of the present invention having a bent pivot.

Referring to FIGS. 4A and 4B for the present invention, the handle 132 includes a bent pivot 133, and the handle 132 is stored into a side of the cabinet 20 by the bent pivot 133 for reducing the area occupied by the cabinet 20 and avoiding any danger caused by the protrusions of the cabinet 20. To enhance the convenience for users, a spring 134 is installed between the pin positioning structure 13 and the cabinet 20 as shown in FIGS. 3A and 3B, such that the insert post 131 is elastically passed through the hole 112 by the spring 134. If the insert post 131 is moved to be separated from the hole 112, the resilience of the spring 134 automatically resumes its position and passes through the hole 112 to enhance the convenience of use.

In addition, the pin positioning structure 13 can move the insert post 131 by some other way, such as building a pressing latch structure for the pin positioning structure 13. After the pressing latch structure is pressed to move back and forth, the pressing latch structure drives the insert post 131 to move accordingly, so that pressing the pressing latch structure can move the insert post 131.

Figure 5A:
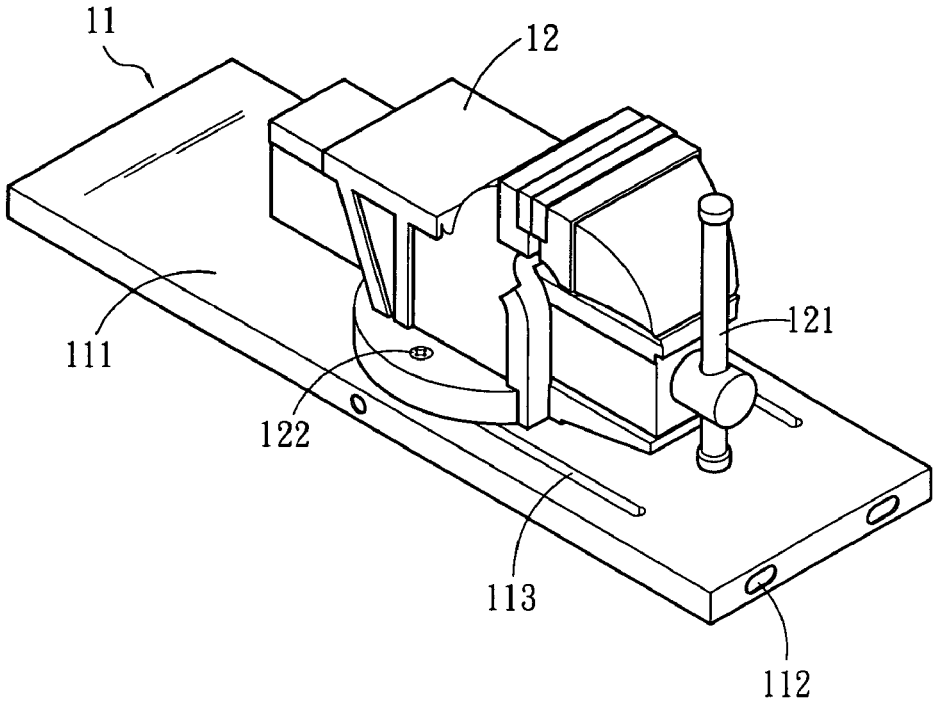
FIG. 5A is a perspective view of a vise having a working platform according to the present invention.
Figure 5B:
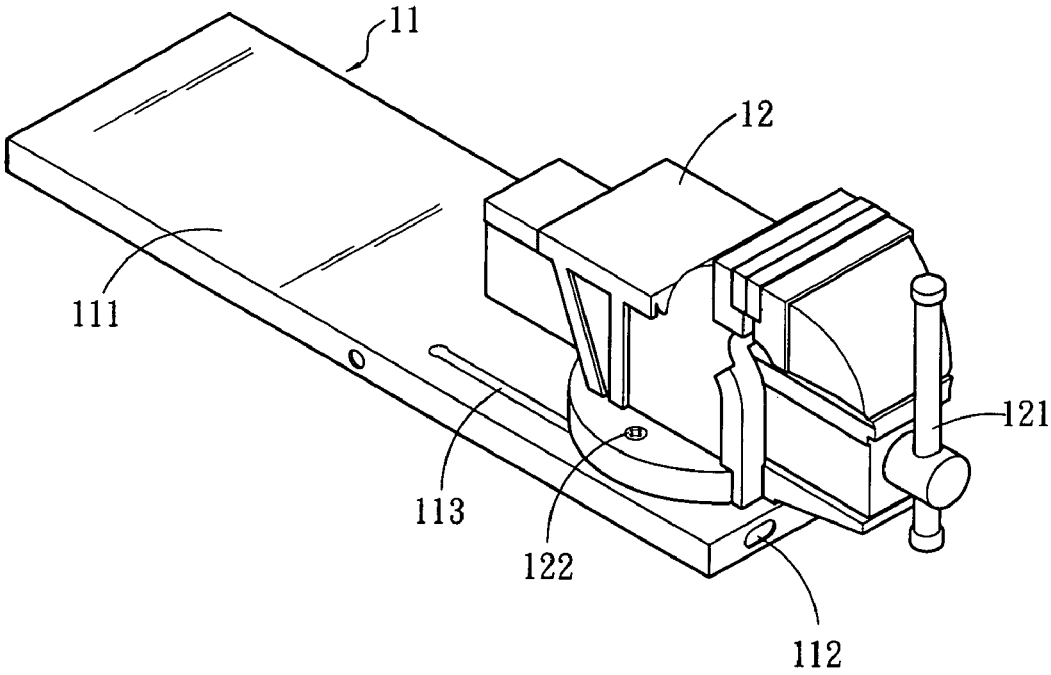
FIG. 5B is another perspective view of a vise having a working platform according to the present invention.
Figure 6:
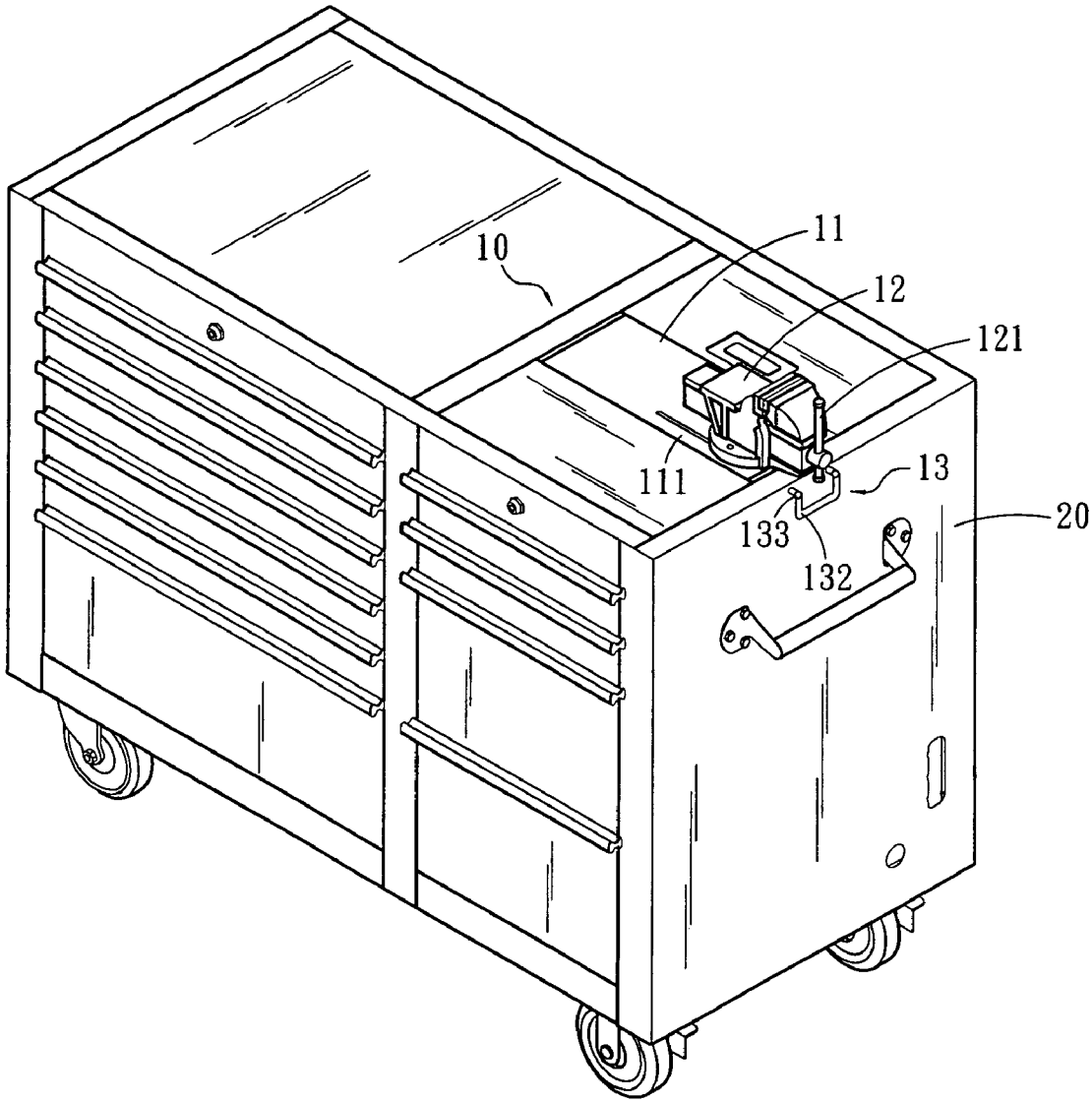
FIG. 6 is a schematic view of installing a working platform having a vise according to the present invention.

The accessory manufacture equipment 12 could be a grinding wheel, a vise, or other manufacturing equipment (the present invention uses a vise for the preferred embodiment). Referring to FIGS. 5A, 5B and 6 for the accessory manufacture equipment 12 being a vise, the working side 111 includes a groove 113 in a long bar shape, and the accessory manufacture equipment 12 is clamped onto a locking member 122 on the groove 113 by a screw, so that the accessory manufacture equipment 12 is fixed at different positions of the groove 113. If it is necessary to turn the working board 11 over, the accessory manufacture equipment 12 can be fixed to a position proximate to middle of the working board 11 as shown in FIG. 5A in order to prevent the accessory manufacture equipment 12 from colliding the cabinet 20 during the process of turning over the working board 11. If it is necessary to fix the working board 11 and use the accessory manufacture equipment 12, the accessory manufacture equipment 12 is fixed to a position proximate to the edge of the working board 11 as shown in FIG. 5B, so that the rotary rod 121 (used for opening or shutting the vise) of the accessory manufacture equipment 12 is resided on an external side of the cabinet 20. Therefore, the rotary rod 121 can be rotated freely. By that time, the handle 132 can be stored into a side of the cabinet 20 by the bent pivot 133 as shown in FIG. 6 to further prevent the handle 132 from being an obstacle to the user's operations, so that a user can easily rotate the rotary rod 121 to use the accessory manufacture equipment 12.

In view of the above description, the accessory manufacture equipment 12 of the present invention can be changed by users as needed and the working board 11 includes two working sides 111 that can be turned over by the working board 11 and alternately shown on the cabinet 20, and thus the working platform 10 is convertible and multifunctional.

What is claimed is:

1. A tool cabinet comprising:

four sides;

a base;

a top;

a storage area;

a working platform forming at least part of said top, said working platform having a flat surface with an opening formed therein;

a working board having two opposite sides, each of said opposite sides having a flat surface, said working board being pivotally coupled to said tool cabinet so that said opposite sides may be pivoted so as to have one flat surface flush with a flat surface of said working platform thus forming a combined working surface for using tools;

at least one mounted workbench tool being disposed on at least one of said two opposite sides of said working board so as to be in an operational position at the surface of the working platform in one position of said working board and in a storage position beneath said surface of the working platform at a second position of said working board.

2. The cabinet of claim 1, further comprising a pin positioning structure disposed on the cabinet and having at least one insert post, wherein both sides of the working board have at least one hole corresponding to each at least one insert post, such that when the working board is pivoted so as to alternately show the first and second working side on the cabinet, the at least one insert post is moved so as to pass into the at least one hole to secure the working board to the cabinet.

3. The tool cabinet of claim 2, wherein the pin positioning structure has a handle coupled and linked to the insert post.

4. The tool cabinet of claim 3, wherein the handle has a pivot, about which the handle may be rotated so as to store the handle at a side of the cabinet.

5. The tool cabinet of claim 2, further comprising a spring disposed between the pin positioning structure and the cabinet, such that when each at least one insert post is aligned with each at least one hole, the spring elastically presses the insert post into the hole.

6. The tool cabinet of claim 2, wherein the pin positioning structure includes a pressing latch structure coupled and linked to the insert post, such that the pressing latch structure is pressed to move the insert post.

7. The tool cabinet of claim 1, wherein the at least one workbench tool is a grinding wheel.

8. The tool cabinet of claim 1, wherein the at least one workbench tool is a vise.

9. The tool cabinet of claim 1, further comprising a storage area beneath said working board, for storing said work bench and for providing a path for said working board as it is pivoted.

10. A tool cabinet comprising:

four sides;

a base;

a top;

a storage area;

a working platform forming at least part of said top, said working platform having a flat surface with an opening formed therein;

a working board pivotally mounted in said opening of said working platform and having two opposite working sides, which when pivoted, said opening presents one of said opposite sides at a position parallel to the surface of said working platform;

at least one of said opposite sides of said working board having at least one groove;

at least one workbench tool mounted on said groove allowing said work bench tool to be adjusted in position along said groove and clamped in position at desired location.

11. A tool cabinet of claim 10, wherein said workbench tool is positioned near one side of said tool cabinet for use and positioned near a center position of said working board for storage.

* * * * *